US005634453A

United States Patent [19]

Taruya et al.

[11] Patent Number: 5,634,453

[45] Date of Patent: Jun. 3, 1997

[54] IGNITION APPARATUS FOR INTERNAL COMBUSTION ENGINE

[75] Inventors: Masaaki Taruya; Mitsuru Koiwa, both of Tokyo, Japan

[73] Assignee: Mitsubishi Denki Kabushiki Kaisha, Tokyo, Japan

[21] Appl. No.: 590,328

[22] Filed: Jan. 23, 1996

[30] Foreign Application Priority Data

Apr. 4, 1995 [JP] Japan ..... 7-079010

[51] Int. Cl.[6] ..... F02P 3/05

[52] U.S. Cl. ..... 123/645; 123/651

[58] Field of Search ..... 123/645, 651, 123/652; 315/209 T

[56] References Cited

U.S. PATENT DOCUMENTS

| | | | |
|---|---|---|---|
| 4,290,406 | 9/1981 | Iyoda et al. | 123/645 |
| 4,886,037 | 12/1989 | Schleupen | 123/645 |
| 4,969,447 | 11/1990 | Di Nunzio et al. | 123/645 |

FOREIGN PATENT DOCUMENTS

| | | |
|---|---|---|
| 4-31664 | 2/1992 | Japan . |
| 5-164031 | 6/1993 | Japan . |
| 5-340330 | 12/1993 | Japan . |

*Primary Examiner*—Tony M. Argenbright

*Attorney, Agent, or Firm*—Sughrue, Mion, Zinn, Macpeak & Seas

[57] ABSTRACT

An ignition apparatus for internal combustion engine includes an ignition power unit 1A having a power transistor 14A for feeding and shutting off a primary current i1 to and from an ignition coil 13 and a control circuit 2 having a CPU 21 for calculating an ignition timing of an internal combustion engine and a feeding time of the primary current in accordance with an operating state D and outputting an ignition signal G to the power transistor, feeds and shuts off the primary current in response to an ignition signal Ga to generate a high-tension secondary voltage from the ignition coil. The power transistor has a characteristic for increasing a direct current amplifying ratio as a base to emitter voltage VBE between a base and emitter increases to suppress the rising-up of the primary current to thereby suppress a secondary voltage generated when the primary current starts to be fed. With this arrangement, the ignition apparatus for internal combustion engine can suppress malfunction when the ignition signal rises up without the use of a high-tension diode and realize cost reduction and miniaturization of the apparatus.

7 Claims, 8 Drawing Sheets

IGNITION APPARATUS FOR INTERNAL COMBUSTION ENGINE

BACKGROUND OF THE INVENTION

1. Field of the Invention

The present invention relates to an electronic distribution type ignition apparatus for internal combustion engine for controlling the feed and shut-oil of a primary current i1 to and from an ignition coil using a power transistor 14, and more specifically, to an ignition apparatus for internal combustion engine by which malfunction caused when the primary current i1 starts to be fed (at the rising-up of an ignition signal) can be effectively prevented without using a high-tension diode.

2. Description of the Related Art

Conventionally, an electronic distribution type ignition apparatus for internal combustion engine having an independent ignition coil for each ignition plug controls an amount of fuel to be injected into each cylinder and an ignition timing by electronic calculation using a microcomputer.

At the time, although a primary current i1 is fed to and shut off from the ignition coil by turning on and off a power transistor 14 in response to an ignition signal, there is a possibility that malfunction such as advanced ignition and the like is caused because a high-tension secondary voltage V2 is induced when the ignition signal rises up.

To prevent the above malfunction, the conventional ignition apparatus for internal combustion engine inserts a high-tension diode to the secondary side of the ignition coil to prohibit the output of the high-tension secondary voltage when the ignition signal rises up.

The conventional ignition apparatus for internal combustion engine will be described below with reference to FIG. 11 and FIG. 12. FIG. 11 is a circuit arrangement diagram showing the conventional ignition apparatus for internal combustion engine and FIG. 12 is a waveform diagram explanatory of operation of the conventional apparatus shown in FIG. 11.

In FIG. 11, an ignition power unit 1 includes an ignition coil 13 composed of a primary coil 11 and a secondary coil 12 and a power transistor 14 for feeding and shutting off a primary current i1 to and from the primary coil 11 and applies a high-tension secondary voltage V2 output from the secondary coil 12 to the ignition plug 3 of each cylinder.

A malfunction preventing high-tension diode 15 is inserted to the output terminal of the secondary coil 12 to cut a positive polarity voltage superposed with the secondary voltage V2. The primary coil 11 and secondary coil 12 in the ignition coil 13 has a common distribution terminal connected to a battery power unit.

The power transistor 14 is composed of an emitter-grounded NPN transistor with its collector connected to the primary coil 11.

A control circuit 2 includes a CPU 21 composed of a microcomputer and an output transistor 22 for amplifying a control signal from the CPU 21. The CPU 21 controls fuel injection to each cylinder of an internal combustion engine in response to an operating state signal D from various sensors (not shown) as well as calculates an ignition timing (corresponding to the shut-off timing of the primary current i1) and a feeding time of the primary current i1 (corresponding to the pulse width of the ignition signal G) to output the ignition signal G to the power transistor 14 through the output transistor 22.

The output transistor 22 is composed of an emitter-grounded NPN transistor with its collector connected to the battery power unit.

The ignition signal G is applied to the base of the power transistor 14 to feed and shut off the primary current i1 to generate the high-tension secondary voltage V2 from the ignition coil 13.

The operating state signal D obtained from the various sensors include, for example, an engine r.p.m., amount of intake air, cooling water temperature, intake manifold pressure, throttle opening, depressed amount of an accelerator pedal and the like.

FIG. 12 is a waveform diagram of various signals in FIG. 11 and shows the change in time of the collector potential Vc of the power transistor 14, primary current i1 and secondary voltage V2.

Next, operation of the conventional ignition apparatus for internal combustion engine shown in FIG. 11 will be described with reference to FIG. 12.

First, the CPU 21 in the control circuit 2 injects fuel to each cylinder of the internal combustion engine at an optimum timing in response to the operating state signal D as well as outputs the ignition signal G to optimize a period of time for feeding the primary current i1 and an ignition timing (shut-off timing).

The power transistor 14 in the ignition power unit 1 is turned on in response to the ignition signal G of H level to start the feed of the primary current i1 to the primary-coil 11.

The ignition signal G is changed to L level at an optimum timing after the primary current i1 reaches a target current value to thereby turn off the power transistor and shut off the primary current i1. With this operation, the high-tension secondary voltage V2 is induced to the secondary coil 12 so that ignition is carried out by spark discharged from the ignition plug 3.

However, when the collector voltage Vc of the power transistor 14 steeply falls down at the rising-up of the ignition signal G, an induction voltage is generated to the ignition coil 13 and a noise signal of relatively high tension is superposed with the secondary voltage V2 as shown by a dotted line of FIG. 12.

If discharged spark is generated to the ignition plug 3 of a cylinder in an intake stroke or compression stroke by such a noise signal, ignition control will be carried out at an undesired earlier timing.

Consequently, the high-tension diode 15 is inserted to the output terminal of the ignition coil 13 to output the secondary voltage V2 from which the superposition of the positive polarity noise signal is cut as shown by a solid line of FIG. 12.

That is, the high-tension diode 15 prohibits the application of the secondary voltage V2 to the ignition plug 3 when the feed of the primary current i1 is started to thereby prevent the advanced ignition of the ignition plug 3. With this arrangement, malfunction can be prevented by suppressing the influence of the secondary voltage V2 when the primary current i1 starts to be fed.

However, the insertion of the high-tension diode 15 increases the number of parts and the circuit arrangements and thus increases the size and weight of the apparatus due to the need of a space for mounting the parts and an insulation space as well as increases a working cost for the assembly of the ignition coil 13 and connection to the coil 12 and the like.

Further, since the high-tension diode 15 is applied with the high-tension secondary voltage V2 and incorporated in the vicinity of the ignition coil 13 which generates high temperature, the diode 15 must be arranged as a component having sufficiently high reliability to endure an adverse environment in which it is used and thus its cost is increased, by which the cost of the apparatus is increased.

Since the conventional ignition apparatus for internal combustion engine has the high-tension diode 15 inserted to the output terminal of the ignition coil 13 for generating the secondary voltage V2 to prevent malfunction caused when the ignition signal G rises up, the apparatus has a problem that the number of parts is increased and thus the apparatus is increased in size, by which its cost in also increased.

SUMMARY OF THE INVENTION

An object of the present invention made to solve the above problem is to provide an ignition apparatus for internal combustion engine for suppressing malfunction caused when an ignition signal rises up without the use of a high-tension diode as well as miniaturizing the apparatus and reducing the cost thereof.

An ignition apparatus for internal combustion engine according to the present invention comprises an ignition power unit having an ignition coil and a power transistor for feeding and shutting off a primary current to and from the ignition coil, and a control circuit including a CPU for calculating an ignition timing of an internal combustion engine and a feeding time of the primary current in accordance with an operating state and outputting an ignition signal to the power transistor to thereby feed and shut off the primary current in response to the ignition signal and generate a high-tension secondary voltage from the ignition coil, the power transistor having a characteristic for increasing a direct current amplifying ratio as a base to emitter voltage between a base and an emitter increases so as to suppress the rising-up of the primary current.

According to the above arrangement, since the direct current amplifying ratio of the power transistor is increased as the base to emitter voltage increases, the rising-up of the primary current is suppressed by gently turning on the power transistor so as to suppress a secondary voltage generated when the primary current starts to be fed.

An ignition apparatus for internal combustion engine according to the present invention further comprises a time constant circuit including a capacitor inserted between a point where the output terminal of a control circuit is connected to the base of a power transistor and the ground for suppressing the rising-up of a ignition signal.

According to the above arrangement, since the rising-up of the ignition signal is suppressed by the time constant circuit including the capacitor inserted between the output terminal of the control circuit and the base of the power transistor, so that a secondary voltage generated when the primary current starts to be fed is further suppressed.

In one form of the present invention, a time constant circuit includes a resistor connected in series to a capacitor, and a collector-grounded PNP transistor having a base connected to the point where the resistor is connected to the capacitor and an emitter connected to the base of a power transistor.

According to the above arrangement, the time constant of the time constant circuit is set to a small value by making an ignition signal effective by turning off the PNP transistor whose base is connected to the positive terminal of the capacitor as the capacitor is charged.

In another form of the present invention, a time constant circuit includes a resistor inserted between the point where the output terminal of a control circuit is connected to a capacitor and the base of a power transistor, and a collector-grounded PNP transistor having a base connected to the point where the capacitor is connected to the resistor and an emitter connected to the base of the power transistor.

According to the above arrangement, the time constant of the time constant circuit is set to a small value by making an ignition signal effective by turning off the PNP transistor whose base is connected to the positive terminal of the capacitor as the capacitor is charged. Further, the power transistor is protected from a serge voltage to be superposed with an ignition signal by the resistor inserted to the base input terminal of the power transistor.

In further form of the present invention, a time constant circuit includes a resistor inserted between capacitor and the ground, a diode inserted in reversed polarity between the point where the output terminal of a control circuit is connected to the capacitor and the base of a power transistor, and a PNP transistor having an emitter connected to the point where the capacitor is connected to the cathode of the diode, a collector connected to the point where the anode of the diode is connected to the base of the power transistor and a base connected to the point where the capacitor is connected to the resistor.

According to the above arrangement, the rising-up of an ignition signal is securely delayed by making an ignition signal effective by turning off the PNP transistor whose base is connected to the negative terminal of the capacitor as the capacitor is charged. Further, the power transistor is tuned off by connecting the base current of the power transistor to the ground through the diode when the ignition signal is turned off.

In further form of the present invention, a time constant circuit includes a resistor connected in series to a capacitor, a diode connected in reversed polarity between the point where the output terminal of a control circuit is connected to the resistor and the base of a power transistor, and an NPN transistor having a collector connected to the point where the resistor is connected to the cathode of the diode, an emitter connected to the point where the anode of the diode is connected to the base of the power transistor and a base connected to the point where the capacitor is connected to the resistor.

According to the above arrangement, the rising-up of an ignition signal is securely delayed by making an ignition signal effective by turning on the PNP transistor whose base is connected to the positive terminal of the capacitor as the capacitor is charged. Further, the power transistor is tuned off by connecting the base current of the power transistor to the ground through the diode when the ignition signal is turned off.

In further form of the present invention, a time constant circuit includes a resistor inserted between a capacitor and the ground, a voltage follower having an inverting input terminal connected to the point where the capacitor is connected to the resistor and a non-inverting input terminal short circuited to the output terminal thereof, and an emitter-grounded NPN transistor having a collector connected to the point where the output terminal of a control circuit is connected to the base of the power transistor and a base connected to the output terminal of the voltage follower.

According to the above arrangement, an ignition signal is made effective by turning off the NPN transistor whose base is connected to the negative terminal of the capacitor through the voltage follower as the capacitor is charged. At the time, the circuit constant of the voltage follower is preset so that the temperature characteristic and the like of the ignition signal is made adjustable.

DESCRIPTION OF PREFERRED EMBODIMENTS

Embodiment 1

An embodiment 1 of the present invention will be described with reference to the drawings.

Figure 1:
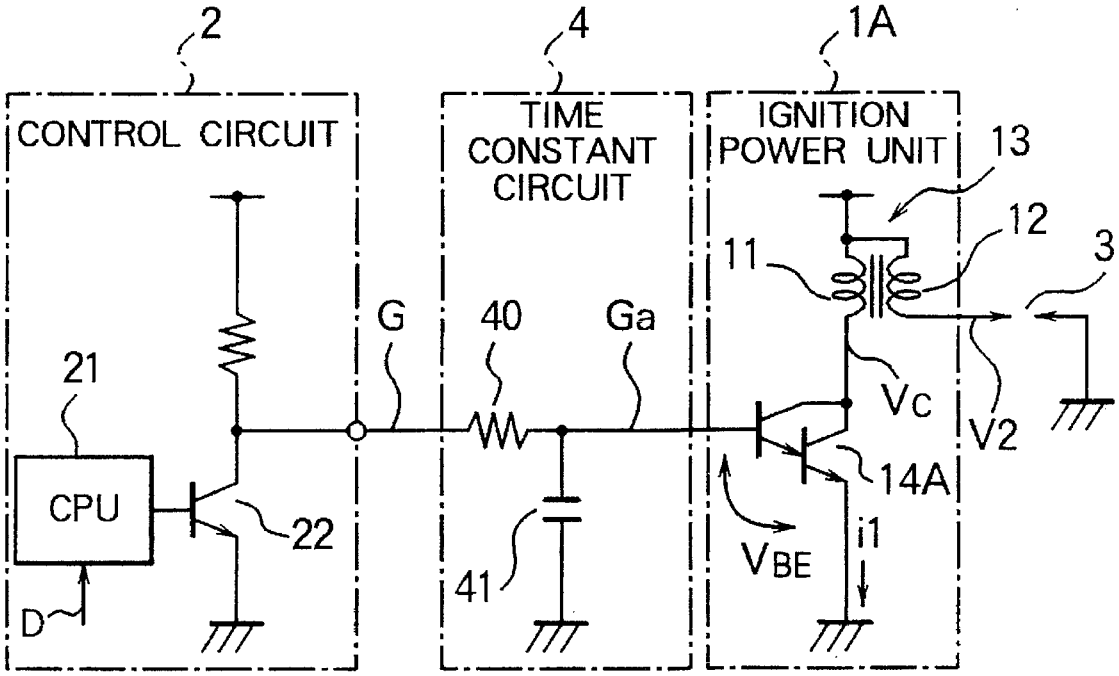
FIG. 1 is a circuit arrangement diagram showing an embodiment 1 of the present invention.
Figure 11:
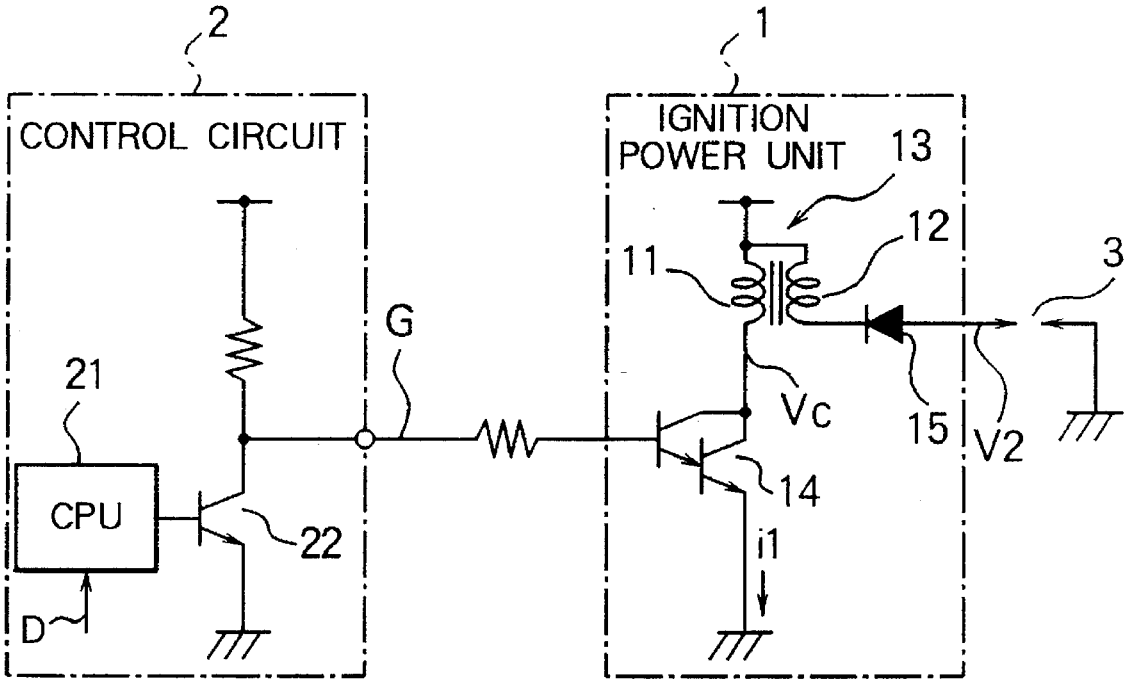
FIG. 11 is a circuit arrangement diagram of a conventional ignition apparatus for internal combustion engine.
Figure 12:
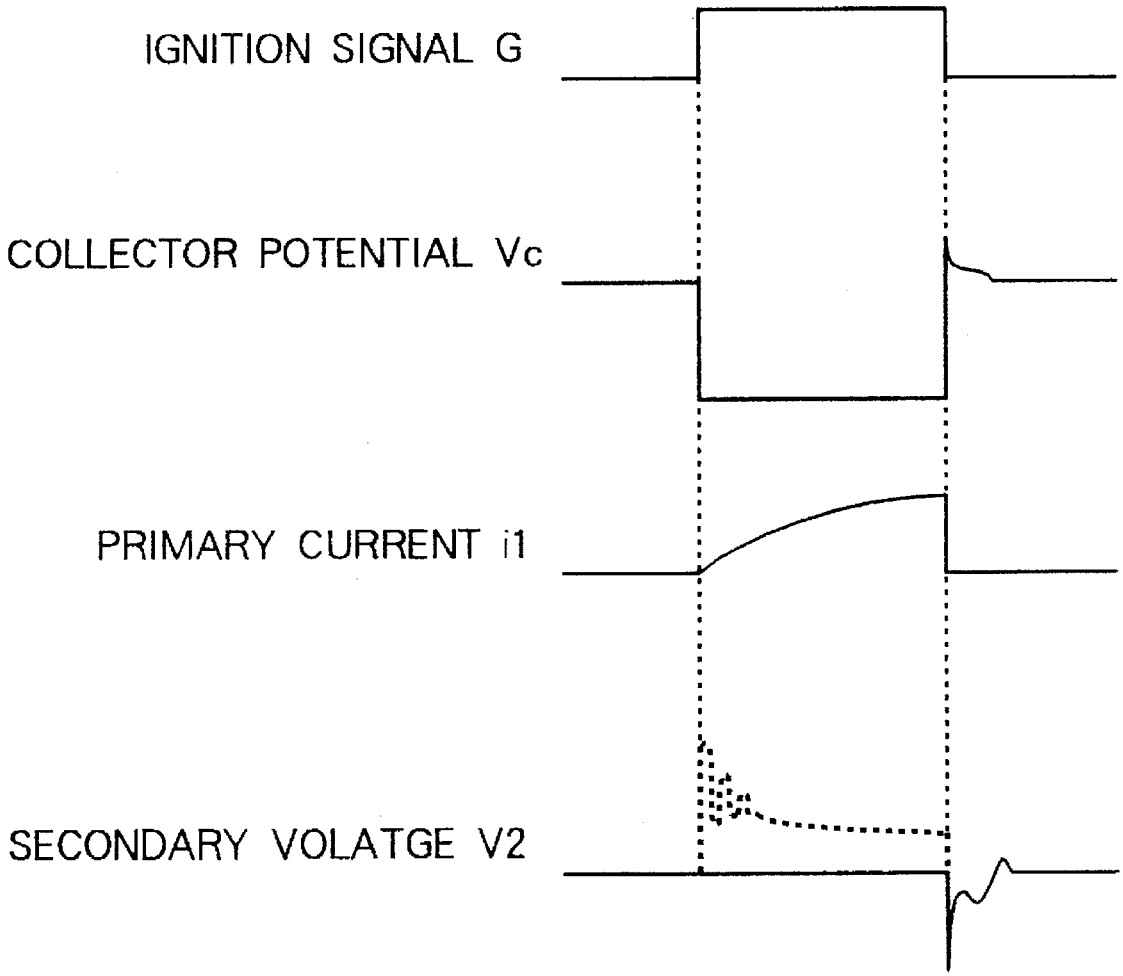
FIG. 12 is a waveform diagram explaining operation of the conventional ignition apparatus for internal combustion engine.

FIG. 1 is a circuit arrangement diagram showing the embodiment 1 of the present invention, wherein a control circuit 2 has an arrangement similar to that of the aforesaid apparatus. In FIG. 1, an ignition power unit includes an ignition coil 13 for outputting a secondary voltage V2 and a power transistor 14A for feeding and shutting off a primary current i1 and is arranged similarly to that of the aforesaid ignition power unit 1 except that the high-tension diode 15 (refer to FIG. 11) is removed therefrom.

In this case, the power transistor 14A has a characteristic that a direct current amplifying ratio hFE increases as a base to emitter voltage VBE between the base and the emitter of the transistor (corresponding to the voltage level of an ignition signal Ga) increases to thereby suppress the rising-up of the primary current i1.

Here, it is to be noted that a resistor having a proper resistance value (not shown) may be connected between the base and the emitter of each of respective Darlington-connected transistors as shown in FIG. 1 to arrange the power transistor 14A having the characteristic for increasing the direct current amplifying ratio hFE as the base to emitter voltage VBE increases.

Further, a time constant circuit 4 is connected between the output terminal of the control circuit 2 and the base of the power transistor 14A to suppress the rising-up of an ignition signal G and provide the ignition signal Ga having a smoothed waveform. The time constant circuit 4 is composed of a resistor 40 inserted between the output terminal of the control circuit 2 and the base of the power transistor 14A and a capacitor 41 inserted between the point where the resistor 40 is connected to the base of the power transistor 14A and the ground.

Figure 2:
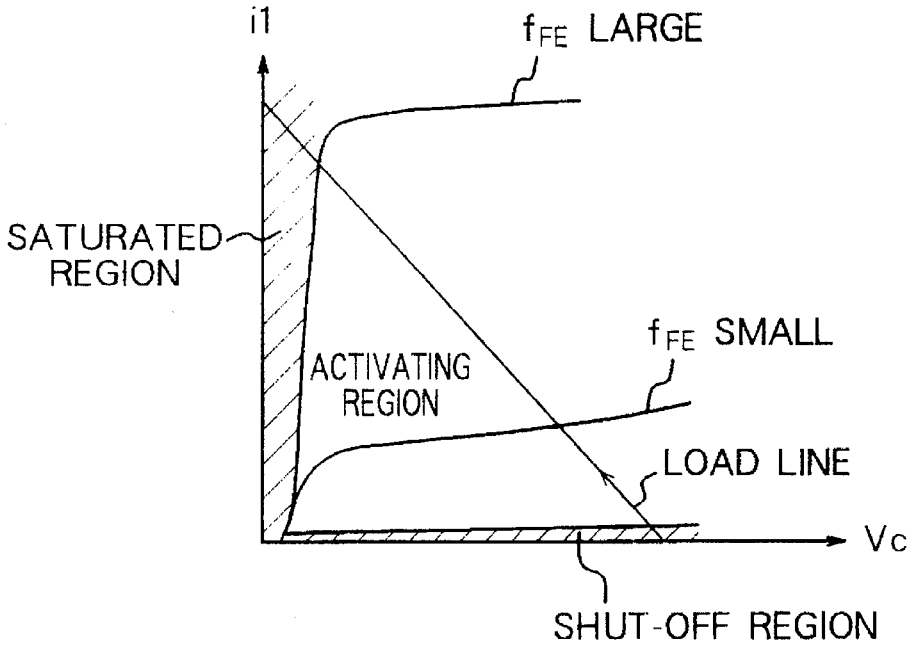
FIG. 2 is a characteristic graph explaining operation of a power transistor used in the embodiment 1 of the present invention.
Figure 3:
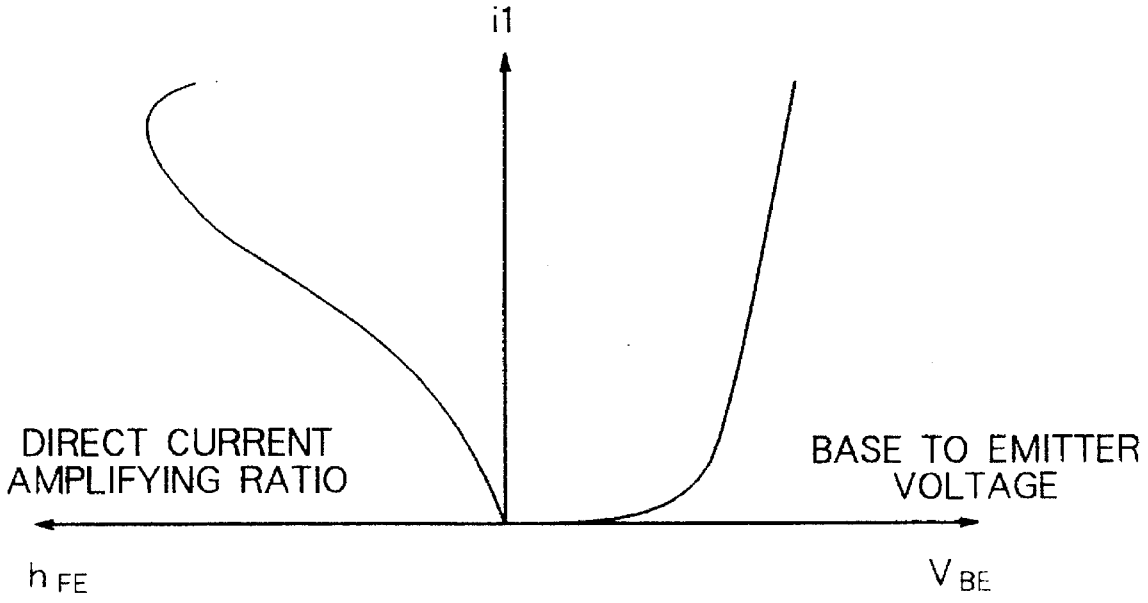
FIG. 3 is a characteristic graph explaining operation of a power transistor used in the embodiment 1 of the present invention.

FIG. 2 and FIG. 3 are characteristic graphs explaining operation of the power transistor 14A in FIG. 1, wherein FIG. 2 shows the change of the primary current i1 to the collector potential Vc (collector to emitter voltage) of the power transistor 14A as the parameter of the direct current amplifying ratio hFE and FIG. 3 shows the change of the primary current i1 to the base to emitter voltage VBE of the power transistor 14A and to the direct current amplifying ratio hFE.

In FIG. 2, when the power transistor 14A has a small direct current amplifying ratio hFE, a characteristic curve approaches the shut-off region (phantom region) in an activating region so that the primary current i1 has a small value at the point where the curve intersects a load line (operating point). Whereas, when the direct current amplifying ratio hFE has a large value, the characteristic curve approaches the saturated region (phantom region) side from the activating region so that the primary current i1 has a large value at the operating point.

In FIG. 3, the primary current i1 is suppressed to a small current value in the region where the base to emitter voltage VBE of the power transistor 14A has a small value, whereas the primary current i1 steeply increases in the region where the base to emitter voltage VBE has a large value.

Further, the primary current i1 is suppressed to a small current value in the region where the direct current amplifying ratio hFE of the power transistor 14A has a small value and as the direct current amplifying ratio hFE increases, the primary current i1 has a larger current value.

Consequently, it can be found from FIG. 3 that the power transistor 14A has such a characteristic as to increase the direct current amplifying ratio hFE thereof as the base to emitter voltage VBE increases so that the rising-up of the primary current i1 can be suppressed.

Figure 4:
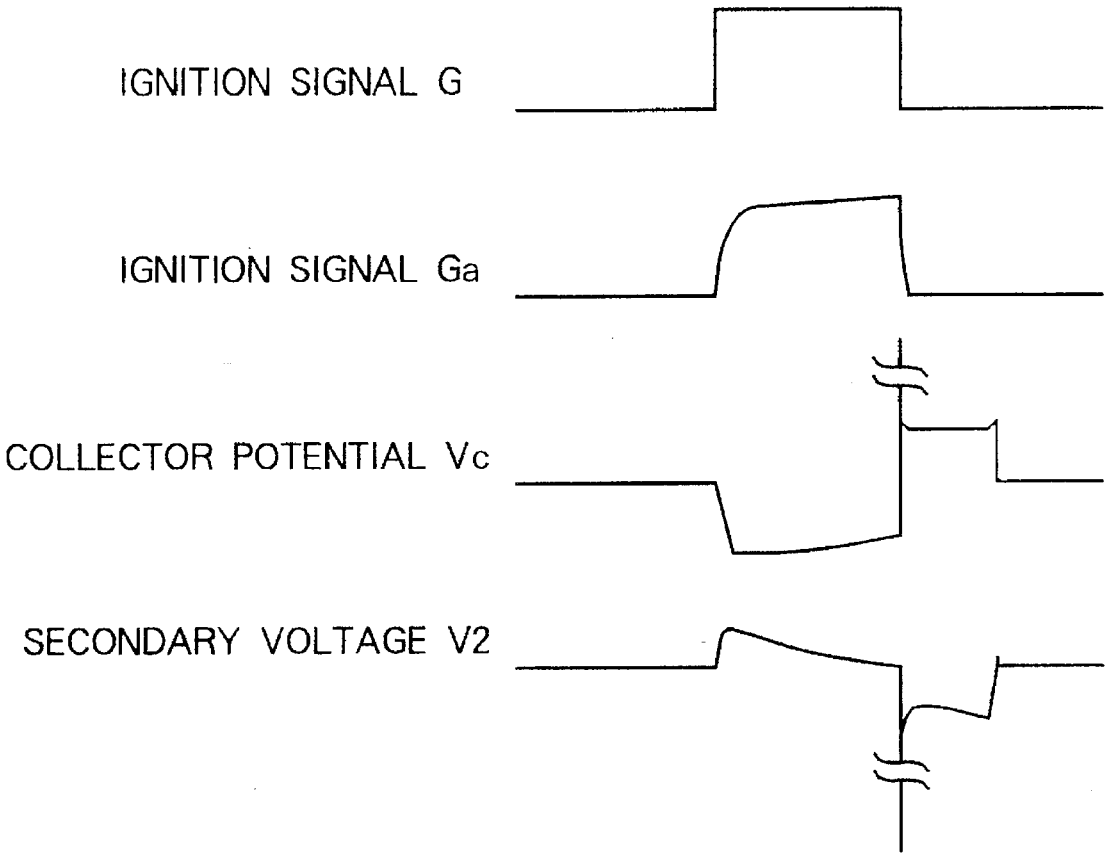
FIG. 4 is a waveform diagram explaining operation of the embodiment 1 of the present invention.
Figure 5:
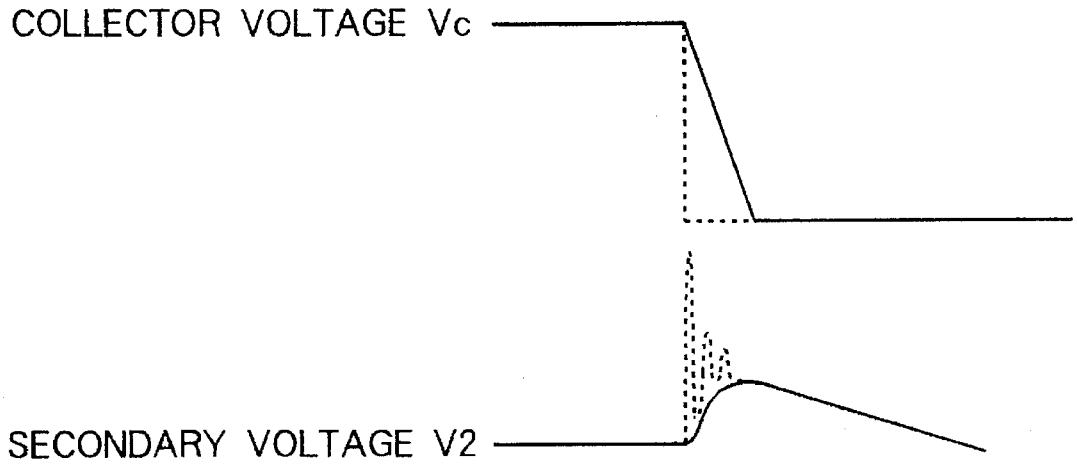
FIG. 5 is a waveform diagram showing a collector potential and the rising-up portion of a secondary voltage in FIG. 4 in an enlarged fashion.

FIG. 4 is a waveform diagram explaining operation of the embodiment 1 of the present invention and shows the change in time of the collector potential Vc and secondary voltage V2 to the ignition signals G and Ga. FIG. 5 is a waveform diagram showing the collector potential Vc and secondary voltage V2 in FIG. 4 in an enlarged fashion and shows waveforms corresponding to the time at which the ignition signal G rises up.

Next, operation of the embodiment 1 of the present invention shown in FIG. 1 will be described with reference to FIG. 2–FIG. 5.

Likewise the aforesaid, a CPU 21 in the control circuit 2 injects fuel into each cylinder at an optimum timing in response to an operating state signal D as well as outputs the ignition signal G for determining the feed and shut-off the primary current i1.

The ignition signal G is converted into the ignition signal Ga having a gently-rising-up waveform and applied to the base of the power transistor 14A in the ignition power unit 1A.

The power transistor 14A starts to feed the primary current i1 in response to the ignition signal Ga and shuts off the primary current i1 at a predetermined ignition timing.

At the time, since the direct current amplifying ratio hFE of the power transistor 14A exhibits a small value as shown in FIG. 3 when the ignition signal Ga rises up, it suppresses the rising-up of the primary current i1.

In addition, since the rising-up of the ignition signal Ga is already suppressed through the time constant circuit 4, the rising-up thereof is further suppressed.

As a result, the steep falling-down of the collector potential Vc as shown by a dotted line of FIG. 5 is prevented (when hFE is not changed) and it gently falls down as shown by a solid line. Therefore, a noise signal (refer to a dotted line of FIG. 5) is not superposed with the secondary voltage V2 when the primary current i1 starts to be fed and thus an ignition plug 3 does not make malfunction.

When the power transistor 14A is operated in the activating region (refer to FIG. 2) by decreasing the direct current amplifying ratio hFE at the initial time of the rising-up of the ignition signal Ga as described above, the operating speed of the power transistor 14A is made slow and thus the primary current i1 rises up gently.

When the voltage level (base to emitter voltage VBE) of the ignition signal Ga is increased subsequent to the above operation, the direct current amplifying ratio hFE of the power transistor 14A smoothly is changed to a large value without any obstacle.

Consequently, the primary current i1 is changed to a large current value in contact with the saturated region from the small current value in the activating region at the point where it intersects the load line (operating point) as shown FIG. 2, so that the ignition coil 13 generates the secondary voltage V2 which is sufficient to cause the ignition plug 3 to discharge spark.

As described above, a high-tension signal can be prevented from being superposed with the secondary voltage V2 without the provision of the high-tension diode 15 (refer to FIG. 11) with the output terminal of the ignition coil 13 by the use of the power transistor 14A having the characteristic change of the direct current amplifying ratio hFE together with the time constant circuit 4.

Therefore, malfunction can be securely prevented with sufficient reliability without increasing cost by the simple circuit arrangement and workability.

In general, the ignition plug 3 has a discharge gap of about 0.8 mm–1.1 mm and the minimum discharge start voltage at the ignition plug 3 in the engine cylinder is about 3 kV–5 kV (1.5 kV or higher even if variable elements are taken into consideration). Usually, since the pressure in the cylinder (approximately equal to the atmospheric pressure) is minimized when a cylinder valve is opened, the discharge start voltage of the ignition plug 3 is also minimized at the time.

Therefore, advanced ignition can be securely prevented by setting the secondary voltage V2 generated when the primary current i1 starts to be fed to less than 1.5 kV.

According to the arrangement of the above embodiment 1, the above object can be achieved because the secondary voltage V2 does not exceeds 1.5 kV at the initial time of the rising-up of the ignition signal Ga.

Embodiment 2

Although the time constant circuit 4 is used together with the power transistor 14A to more effectively suppress the rising-up of the secondary voltage V2 in the above embodiment 1, it is needless to say that an effect to suppress the rising-up voltage of the secondary voltage V2 to less than 1.5 kV can be achieved even if only the power transistor 14A having the characteristic change of the direct current amplifying ratio hFE as described above is used without using the time constant circuit 4 together with it.

Embodiment 3

Further, although the time constant circuit 4 composed of the resistor 40 inserted to the input terminal of the power transistor 14A and the grounded capacitor 41 is used in the above embodiment 1 taking the simplification of the arrangement and cost reduction into consideration, a time constant circuit composed of various circuit arrangements may be used in accordance with required specifications and the like.

An embodiment 3 of the present invention using a time constant circuit capable of setting a time constant smaller than that in FIG. 1 will be described with reference to the drawings.

Figure 6:
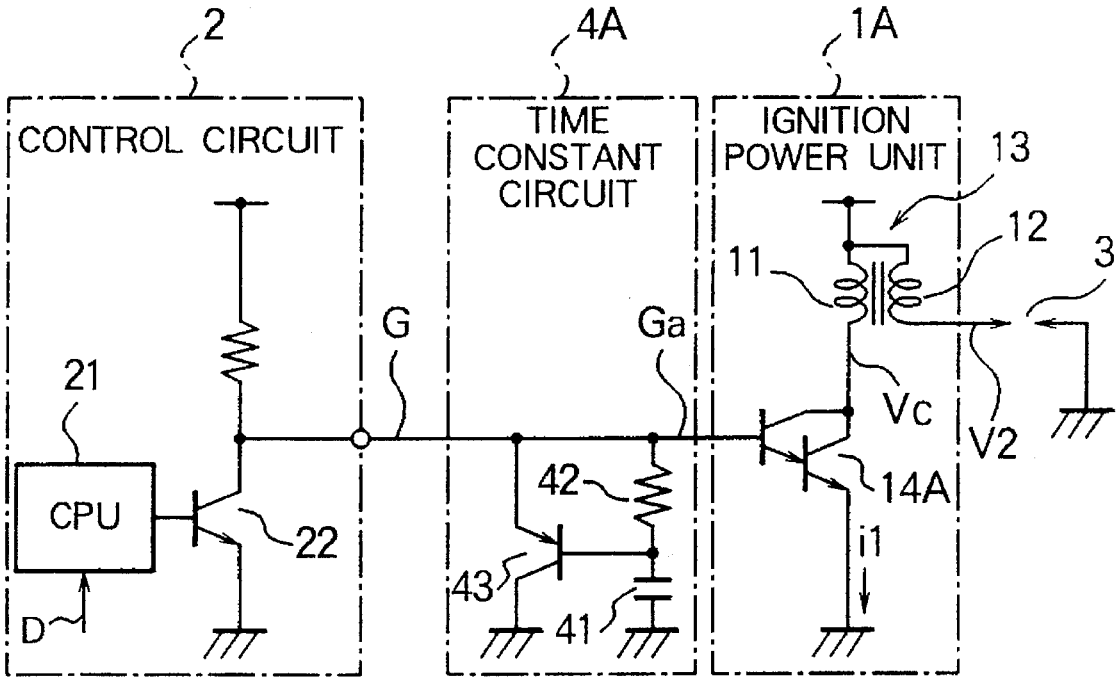
FIG. 6 is a circuit arrangement diagram showing an embodiment 3 of the present invention.
Figure 7:
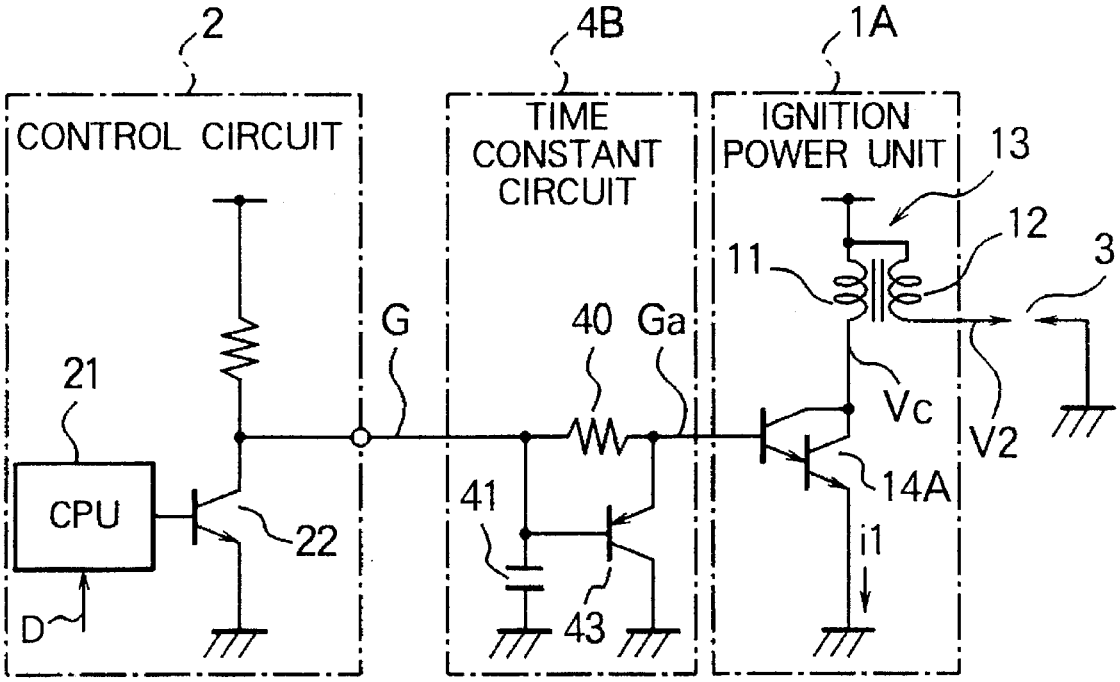
FIG. 7 is a circuit arrangement diagram showing another example of the embodiment 3 of the present invention.

FIG. 6 and FIG. 7 are circuit arrangement diagrams showing time constant circuits 4A and 4B according to the embodiment 3 of the present invention. In the respective drawings, the embodiment 3 is arranged similarly to that shown in FIG. 1 except the circuit arrangements in the time constant circuits 4A and 4B are different from that shown in FIG. 1.

In FIG. 6, the time constant circuit 4A is composed of a resistor 42 connected in series to a capacitor 41 and a collector-grounded PNP transistor 43 having a base connected to the point where the resistor 42 is connected to the capacitor 41 and an emitter connected to the base of a power transistor 14A.

In FIG. 7, the time constant circuit 4B is composed of a resistor 40 inserted between the point where the output terminal of a control circuit 2 is connected to the capacitor 41 and the base of the power transistor 14A and the collector-grounded PNP transistor 43 having the base connected to the point where the capacitor 41 is connected to the resistor 40 and the emitter connected to the base of the power transistor 14A.

In both of the time constant circuits 4A and 4B shown in FIG. 6 and FIG. 7, the ignition signal Ga is made effective when the PNP transistor 43 is turned off by the increase of the charged voltage of the positive terminal of the capacitor 41. With this operation, a noise signal to be superposed with the secondary voltage V2 can be securely suppressed. Further, a time constant for delaying the rising-up of the ignition signal Ga and secondary voltage V2 can be set to a small value.

That is, although the time constant of the time constant circuit 4 in FIG. 1 (embodiment 1) relates to a period of time until the charged voltage of the capacitor 41 reaches the base to emitter voltage VBE of the power transistor 14A, the time constant of the time constant circuits 4A and 4B (embodiment 3) relates to a period of time until the charged voltage of the capacitor 41 reaches the base to emitter voltage of the PNP transistor 43 (about one half the base to emitter voltage VBE of the power transistor 14A). Consequently, the time constant can be set to a small value which is about one half the time constant of the embodiment 1.

Further, in the case of FIG. 7, since the resistor 40 is provided similar to the case of FIG. 1, even if a serge voltage is superposed with the ignition signal G output from the control circuit 2, for example, the power transistor 14A, PNP transistor 43 and the like can be protected.

Embodiment 4

Note, although the above embodiment 3 shows the case that the PNP transistor 43 which is turned off when the capacitor 41 is charged is connected in parallel between the base and the emitter of the power transistor 14A and the time constant for delaying the rising-up of the ignition signal Ga is set to the small value, it is also possible to more securely delay the rising-up of the ignition signal Ga by inserting a PNP transistor or NPN transistor which is turned on when the capacitor 41 is charged to the base terminal of the power transistor 14A.

An embodiment 4 of the present invention for more securely delaying the rising-up of the ignition signal Ga using the turning-on delay of the PNP transistor or NPN transistor will be described with reference to the drawings.

Figure 8:
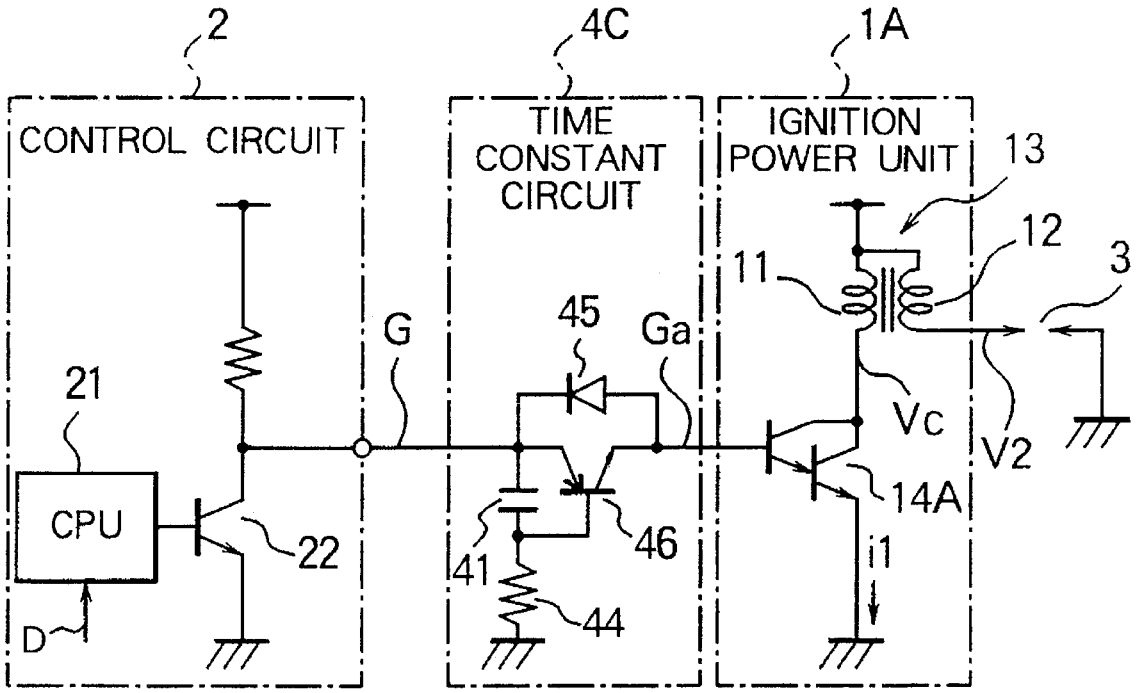
FIG. 8 is a circuit arrangement diagram showing an embodiment 4 of the present invention.
Figure 9:
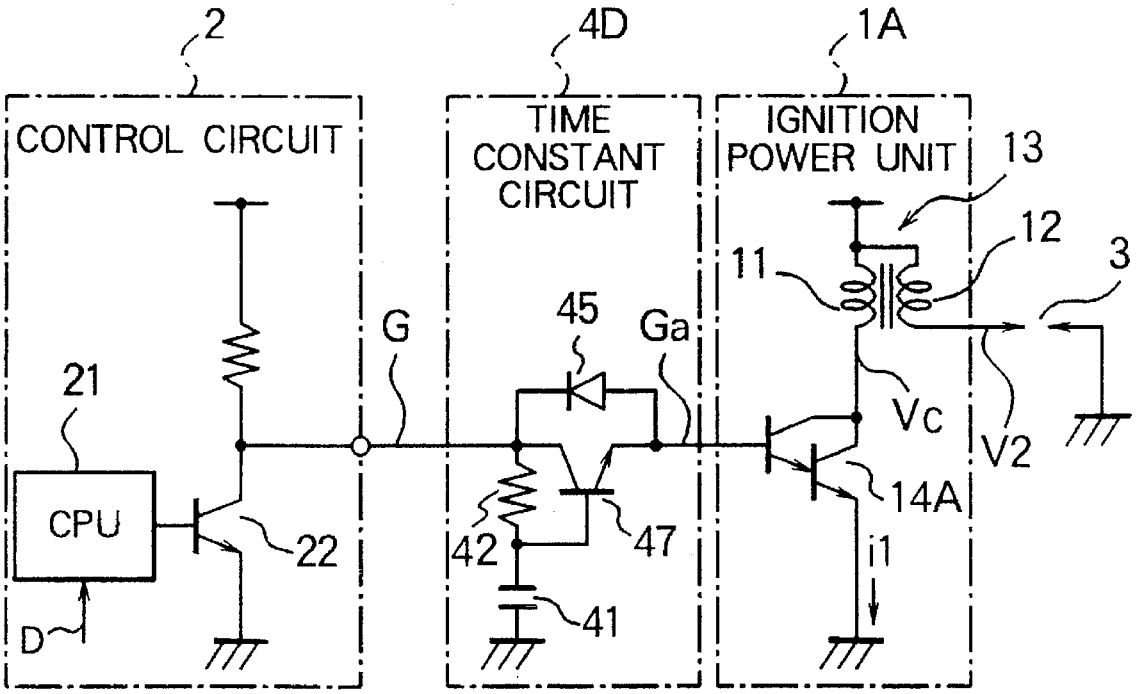
FIG. 9 is a circuit arrangement diagram showing another example of the embodiment 4 of the present invention.

FIG. 8 and FIG. 9 are circuit arrangement diagrams showing time constant circuit 4C and 4D according to the embodiment 4 of the present invention. In the respective drawings, the embodiment 4 is similar to that shown in FIG. 1 except the circuit arrangements of the time constant circuits 4C and 4D.

In FIG. 8, the time constant circuit 4C is composed of a resistor 44 inserted between a capacitor 41 and the ground, a diode 45 inserted in reversed polarity between the point where the output terminal of a control circuit 2 is connected to the capacitor 41 and the base of a power transistor 14A and a PNP transistor 46 having an emitter connected to the point where the capacitor 41 is connected to the cathode of the diode 45, a collector connected to the point where the anode of the diode 45 is connected to the base of the power transistor 14A and a base connected to the point where the capacitor 41 is connected to the resistor 44.

In FIG. 9, the time constant circuit 4D is composed of a resistor 42 connected in series to the capacitor 41, the diode 45 inserted in reversed polarity between the point where the output terminal of the control circuit 2 is connected to the resister 42 and the base of the power transistor 14A and an NPN transistor 47 having a collector connected to the point where the resistor 42 is connected to the cathode of the diode 45, an emitter connected to the point where the anode of the diode 45 is connected to the base of the power transistor 14A and a base connected to the point where the capacitor 41 is connected to the resistor 42.

In the time constant circuit 4C of FIG. 8, the voltage of the negative terminal of the capacitor 41 is reduced when it is charged, so that the ignition signal Ga is made effective when the PNP transistor 46 is turned on.

Further, in the time constant circuit 4D of FIG. 9, the voltage of the positive terminal of the capacitor 41 is increased when it is charged, so that the ignition signal Ga is made effective when the NPN transistor 47 is turned on.

With these operations, the rising-up operation of the ignition signal Ga can be securely delayed.

On the other hand, the diode 45 connected in parallel to the PNP transistor 46 or NPN transistor 47 is needed when the power transistor 14A is to be turned off. That is, when an output transistor 22 in the control circuit 2 is turned on and the ignition signal G is changed to L level and the PNP transistor 46 or NPN transistor 47 is turned off, the power transistor 14A is turned off by a base current which is grounded through the diode 45.

As shown in FIG. 8 and FIG. 9, an effect for suppressing the rising-up of the secondary voltage V2 is increased with an improved suppressing accuracy by the arrangement that the parallel circuit composed of the diode 45 and the PNP transistor 46 or NPN transistor 47 is inserted to the input terminal (base) of the power transistor 14A and the base of the PNP transistor 46 (or NPN transistor 47) is connected to the negative terminal (or positive terminal) of the capacitor 41.

Embodiment 5

Note, although the PNP transistor 46 is turned off directly using the charged voltage of the positive terminal of the capacitor 41 in the above embodiment 3 (FIG. 7 and FIG. 8), the NPN transistor 47 may be turned off through a variable characteristic voltage follower (operational amplifier fed back to a non-inverting input terminal) connected to the negative terminal of the capacitor 41.

An embodiment 5 of the present invention which enables the adjustment of the temperature characteristic and the like of a time constant through the voltage follower will be described with reference to the drawings.

Figure 10:
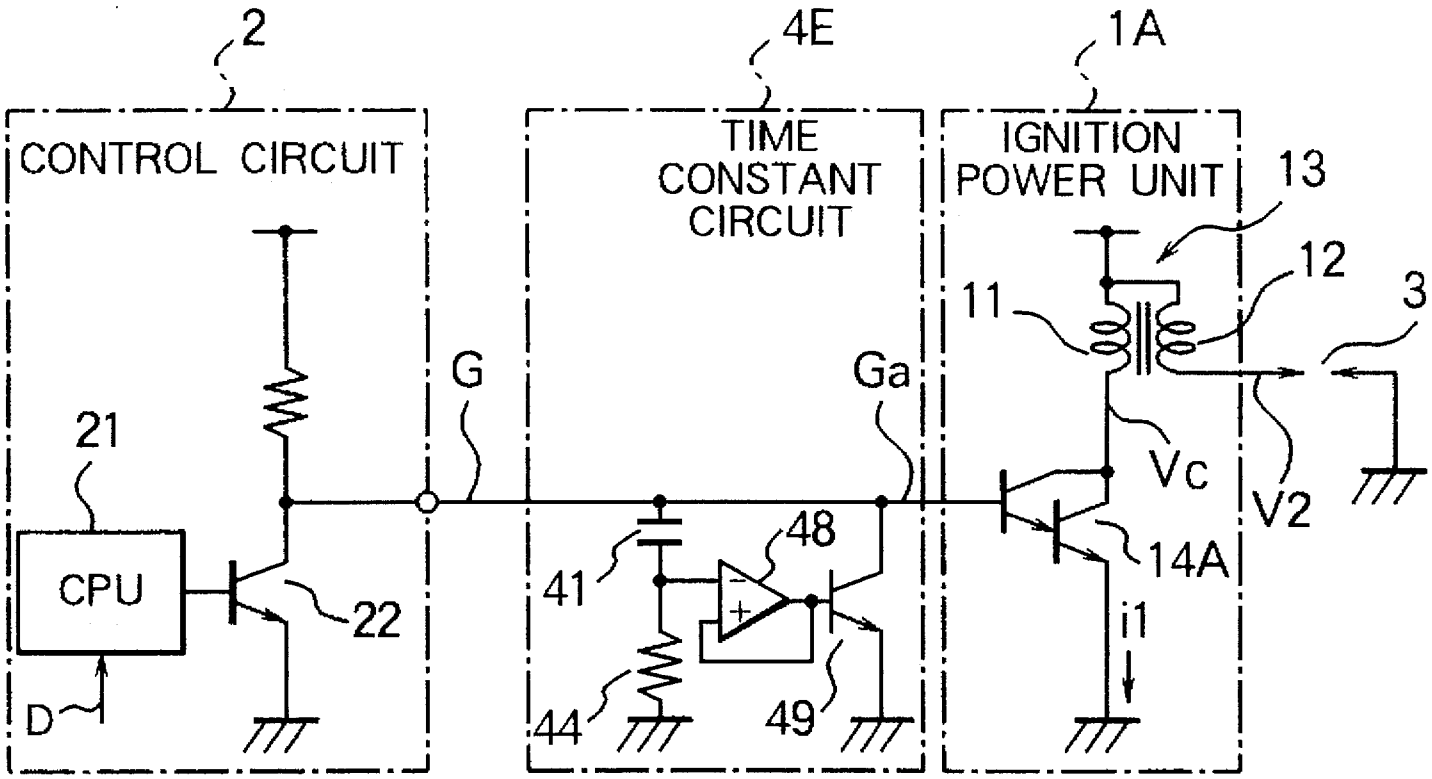
FIG. 10 is a circuit arrangement diagram showing an embodiment 5 of the present invention.

FIG. 10 is a circuit arrangement diagram showing a time constant circuit 4E according to the embodiment 5 of the present invention. The embodiment 5 is similar to that shown in FIG. 1 except the circuit arrangement of the time constant circuit 4E.

In FIG. 10, the time constant circuit 4E is composed of a resistor 44 inserted between a capacitor 41 and the ground, a voltage follower 48 having an inverting input terminal (–) connected to the point where the capacitor 41 is connected to the resistor 44 and a non-inverting input terminal. (+) short circuited to the output terminal thereof and an emitter-grounded NPN transistor 49 having a collector connected to the point where the output terminal of a control circuit 2 is connected to the base of a power transistor 14A and a base connected to the output terminal of the voltage follower 48.

The voltage follower 48 applies the voltage of the negative terminal of the capacitor 41 to the base of the NPN transistor 49 and turns oil the NPN transistor 49 by setting its output voltage less than the base to emitter voltage VBE of the NPN transistor 49 when the negative terminal voltage of the capacitor 41 is made lower than a predetermined value by the charging thereof. Further, the circuit constant of the voltage follower 48 is preset to satisfy arbitrary characteristics.

The time constant circuit 4E shown in FIG. 10 can also securely suppress a noise signal to be superposed with the secondary voltage V2 similarly to the aforesaid.

Further, since the negative terminal of the capacitor 41 is connected to the inverting input terminal (–) of the voltage follower 48 and the output terminal of the voltage follower 48 is connected to the base of the emitter-grounded NPN transistor 49 as shown in FIG. 10, temperature characteristic and the like can be adjusted and a suppressing accuracy can be further improved.

What is claimed is:

1. An ignition apparatus for internal combustion engine comprising:

an ignition power unit having an ignition coil and a power transistor for feeding and shutting off a primary current to and from the ignition coil; and a control circuit including a CPU for calculating an ignition timing of an internal combustion engine and a feeding time of said primary current in accordance with an operating state and outputting an ignition signal to said power transistor to thereby feed and shut off said primary current in response to said ignition signal and generate a high-tension secondary voltage from said ignition coil, said power transistor having a characteristic for increasing a direct current amplifying ratio as a base to emitter voltage between a base and an emitter increases so as to suppress the rising-up of said primary current.

2. An ignition apparatus for internal combustion engine according to claim 1, comprising a time constant circuit including a capacitor inserted between a point where the output terminal of said control circuit is connected to the base of said power transistor and the ground for suppressing the rising-up of said ignition signal.

3. An ignition apparatus for internal combustion engine according to claim 2, wherein said time constant circuit includes:

a resistor connected in series to said capacitor; and a collector-grounded PNP transistor having a base connected to the point where said resistor is connected to said capacitor and an emitter connected to the base of said power transistor.

4. An ignition apparatus for internal combustion engine according to claim 2, wherein said time constant circuit includes:

a resistor inserted between the point where the output terminal of said control circuit is connected to said capacitor and the base of said power transistor; and a collector-grounded PNP transistor having a base connected to the point where said capacitor is connected to said resistor and an emitter connected to the base of said power transistor.

5. An ignition apparatus for internal combustion engine according to claim 2, wherein said time constant circuit includes:

a resistor inserted between said capacitor and the ground;

a diode inserted in reversed polarity between the point where the output terminal of said control circuit is connected to said capacitor and the base of said power transistor; and a PNP transistor having an emitter connected to the point where said capacitor is connected to the cathode of said diode, a collector connected to the point where the anode of said diode is connected to the base of said power transistor and a base connected to the point where said capacitor is connected to said resistor.

6. An ignition apparatus for internal combustion engine according to claim 2, wherein said time constant circuit includes:

a resistor connected in series to said capacitor;

a diode inserted in reversed polarity between the point where the output terminal of said control circuit is connected to said resistor and the base of said power transistor; and an NPN transistor having a collector connected to the point where said resistor is connected to the cathode of said diode, an emitter connected to the point where the anode of said diode is connected to the base of said power transistor and a base connected to the point where said capacitor is connected to said resistor.

7. An ignition apparatus for internal combustion engine according to claim 2, wherein said time constant circuit includes:

a resistor inserted between said capacitor and the ground;

a voltage follower having an inverting input terminal connected to the point where said capacitor is connected to said resistor and a non-inverting input terminal short circuited to the output terminal thereof; and an emitter-grounded NPN transistor having a collector connected to the point where the output terminal of said control circuit is connected to the base of said power transistor and a base connected to the output terminal of said voltage follower.

* * * * *